United States Patent [19]

Partridge

[11] 3,969,869

[45] July 20, 1976

[54] BUILDING TRUSS

[76] Inventor: Arthur F. Partridge, 1775 Delaware Ave., St. Paul, Minn. 55118

[22] Filed: Sept. 20, 1974

[21] Appl. No.: 507,952

[52] U.S. Cl. ..... 52/639; 52/690

[51] Int. Cl.[2] ..... E04C 3/02; E04B 1/32

[58] Field of Search ..... 52/639–645, 52/90–93, 690–694, 731, 262, 655, 263; 403/403, 205, 231, 232, 382; 29/150

[56] References Cited

UNITED STATES PATENTS

| | | | |
|---|---|---|---|
| 1,184,080 | 5/1916 | D'Arcy | 403/231 |
| 1,230,305 | 6/1917 | Klay | 52/90 |
| 2,272,910 | 2/1942 | Gobberdiel | 52/262 |
| 2,288,052 | 6/1942 | Walker | 52/690 |
| 2,345,500 | 3/1944 | Petter | 52/262 |
| 2,542,151 | 2/1951 | McAuliffe | 52/262 |
| 2,840,014 | 6/1958 | Wadsworth et al. | 52/753 L |
| 2,886,857 | 5/1959 | Brosenius | 52/726 |
| 3,263,381 | 8/1966 | Dickinson | 52/90 |
| 3,479,783 | 11/1969 | Jureit | 52/639 |

FOREIGN PATENTS OR APPLICATIONS

| | | | |
|---|---|---|---|
| 44,106 | 5/1910 | Austria | 52/91 |

*Primary Examiner*—Ernest R. Purser
*Assistant Examiner*—James L. Ridgill, Jr.
*Attorney, Agent, or Firm*—Warren R. Bovee

[57] ABSTRACT

Trusses for static structures comprising a framework of structural members forming peaked or extended trusses. Truss components can be prefabricated to provide compact, easily assembled components for trusses in residential and commercial buildings. Peaked and extended scissors trusses can also be assembled from prefabricated, interlocking truss components to provide integrally supported, peaked and extended scissors trusses. Static structures and building modules comprising the trusses are described.

15 Claims, 9 Drawing Figures

BUILDING TRUSS

The present invention relates to peaked and extended building trusses and to static structures, such as residential, agricultural and commercial buildings and building modules, employing the roof-supporting trusses of the present invention. One aspect of the invention relates to lapped scissors trusses for providing prefabricated, easily assembled static structures which are functionally unique and esthetically pleasing. A further aspect of the invention relates to high strength, interlocking peaked and extended scissors trusses. The components of these interlocking trusses can be prefabricated and readily transported and assembled to form peaked and extended interlocking building trusses.

With the development and change in architectural design and building methods, the need has developed for building frames comprised of prefabricated units adapted to support a roof, or roof and walls, as in an arch, which provide a maximum unobstructed interior area within the wall enclosure with minimum obstructions by interior supporting members such as partitions, posts, or beams. Conventional construction techniques utilizing a roof supported by rafters and interior partitions are not satisfactory for many uses. The use of trusses and laminated beams provide the necessary support for wide-span roofs with a minimum of interior supporting elements, e.g. posts, beams, tying members, and interior floor-to-ceiling partitions. See, for example, U.S. Pat. Nos. 2,385,142 and 2,967,332. Such large structural members, however, are expensive to manufacture and are often long and awkward to handle so as to be difficult to transport from the point of manufacture to the building site.

Accordingly, it has been proposed to provide prefabricated roof supporting units which can be assembled from smaller components at a site remote from the point of manufacture of the said components; see, for example, U.S. Pat. Nos. 2,542,151; 2,652,599; 2,886,857; and 3,494,089. The heretofore known prefabricated structural members have been limited in design and have not provided builders with the necessary flexibility in building design needed for modern efficient and esthetically pleasing residential, agricultural and commercial buildings.

According to the present invention there is provided unique building trusses having a peaked or extended form. The building trusses of this invention can be used in static structures such as small residential or utility buildings or larger agricultural or commercial buildings. The trusses can also be used with advantage in readily assembled, prefabricated building modules.

The trusses of the present invention are peaked or extended scissors trusses comprising a framework of rigid structural members forming a pair of mated, overlapping, complementary truss components. Each of the two complementary truss components comprises longitudinally extending members forming upper and lower chords, preferably these upper and lower chords are vertically coplanar. The chords are in fixed, angled relation such that one end of the lower chord of each truss component intersects and connects with the corresponding upper chord, the opposite end of the lower chord being maintained in fixed, spaced relation to the upper chord by at least one transverse member connecting the upper and lower chords. Thus, lines drawn between the connecting points of the upper and lower chords and the transverse member define a triangle. The complementary truss components are mated such that the complementary upper and lower chords are in parallel vertical planes, preferably adjacent vertical planes, crossing in angled relation, i.e. their horizontal planes intersect, with means, such as conventional fastening means known in the building construction art, resisting angular relative movement of the truss components. The truss components can be identical or different depending on the design of the truss as will be seen hereinafter.

One aspect of the present invention relates to trusses comprising a pair of adjacent, overlapping truss components wherein the two complementary truss components are mated and maintained in fixed relation by conventional fastening means.

Another aspect of the invention relates to peaked and extended scissors trusses comprising a pair of mated truss components designed to interlock in an advantageous manner to provide integral supporting and strengthening means whereby the fastening means used to mate the complementary truss components bear little or none of the shear forces resulting from vertical loads applied to the truss. Truss components providing these advantages comprise longitudinally extending members forming upper and lower chords, preferably vertically coplanar. The chords are in fixed, angled relation such that one end of the lower chord of each truss component intersects and connects with the corresponding upper chord, the opposite end of the lower chord being maintained in fixed, spaced relation to the upper chord by at least one transverse member connecting the upper and lower chords. The lower chord members have fixed thereto, and integral therewith, support means (referred to herein as "scissors support" or "scissors cradle" means) adapted to engage and support the complementary lower chord of the complementary truss component when the components are mated. These scissors support means prevent an increase in distance between the distal portions of the truss due to relative rotation of the truss components. This prevents the truss from flattening and spreading outwardly under heavy vertical loads.

In addition, the upper chords may have fixed thereon, and integral therewith, means adapted to engage and support the complementary lower chord, referred to hereinafter as a "scissors stop", at a point where the complementary lower chord crosses or meets the upper chord. This support or scissor stop aids in resisting relative rotation of the truss components.

The construction of the truss components with the integral scissors cradle and scissors stop means provides a truss wherein the fastening means used to mate the complementary truss components bear little or no load and in particular are not subject to high shear forces.

An aspect of the invention relates to prefabricated truss components which can be mated to form the trusses of the present invention.

A further aspect of the invention relates to an article which can be conveniently used as an integral supporting means for the trusses of the invention.

Yet another aspect relates to static structures such as residential, agricultural, or commerical buildings employing the trusses of the present invention and prefabricated building modules employing these trusses, which modules are useful in constructing completed static structures.

The term "truss" as used herein refers to a roof-supporting framework of structural members which can be supported some distance from groud or floor level by an upwardly projecting wall or which has its distal ends or "feet" resting directly on the ground or floor level as in a typical A frame structure. Thus, included within the present definition, are trusses wherein the truss forms an arched structure supporting both the roof and walls of the building. A single truss design can be employed to serve either function simply by adapting the truss components so they can be mated at the required angle and modifying the chord length to provide the necessary interior height as will be seen more fully hereinafter.

As noted previously the trusses disclosed herein can be of a "peaked" or "extended" form. As used herein, the term "peaked" refers to trusses wherein the upper chords form a peaked profile and support a traditional peaked roof. The upper chords of the truss meet but do not extend significantly beyond the meeting point. An extended truss on the other hand refers to a truss wherein one or both of the upper truss chords extend beyond the meeting point of the chords to form a "sawtooth" or "butterfly" profile or means for supporting a secondary peaked roof to provide protected ventilating or lighting means in the roof portion of a static structure. Examples of peaked and extended trusses will be described in greater detail hereinafter.

The unique interlocking truss design of the present invention provides means for utilizing relatively thin structural members to provide an unusually strong truss by laminating or "doubling" certain of the structural members to provide a truss of increased strength while also providing integral support members for the upper and lower chords and achieving a multiple effect from laminating or doubling the truss members. The integral supporting or "cradling" of the truss components by the scissors support integral with the complementary chord portions of the truss provides a compact truss achieving maximum strength from the members of the truss itself and further provides a truss which need not depend on the fasteners used in mating the truss components to provide load-bearing strength. Rather, the truss design only requires that the component fasteners hold the truss components in the proper interlocking relationship while allowing only a very small portion of the load to be borne by the fastening means used in mating the truss components.

The strength and internal load distribution inherent in the lapped scissors trusses of the present invention allows the trusses to support heavy loadings over and above their own weight, e.g. when an excessive load is placed on the truss-supported roof, as by the force of the wind or an accumulation of snow, with no tendency for the distal portions or "feet" of the truss to spread outwardly or cause the supporting wall members of the static structures to be forced outward. Because the external forces acting on the truss are distributed and contained in equilibrium within the triangular core of the truss itself, the truss exerts only direct downward pressure on the supporting walls so that the walls need not be thickened or buttressed as when using conventional vaulted roof supports.

The trusses of this invention can be used to construct static structures having great strength and a maximum of usable interior space free from interference by other structural members such as partitions, posts, columns, cables and the like. In structures using the trusses of this invention, only the exterior walls are load bearing, and interior partitions can be positioned or eliminated at will allowing great freedom in interior design. Moreover, the design of the truss components and trusses provide the flexibility to construct peaked roof structures as well as structures having irregular roof lines and incorporating useful ventilating and lighting effects. The interiors of buildings employing these trusses are enhanced by the design of the trusses which can provide a pleasing exposed beam effect, although conventional interior ceilings which hide the trusses can be constructed if desired.

The truss components of this invention can be conveniently fabricated at a site remote from the actual construction site, thereby minimizing on-site construction time and equipment. Since the truss components can be fabricated at a site remote from the construction site, they can be manufactured in a convenient central location, under controlled environmental conditions (e.g., indoors), employing skilled labor and fabricated to close tolerances. The components can be manufactured during periods when actual on-site construction activity is at a maximum, e.g., during severe winter weather, rainy seasons and the like. Thus, the truss components and the resulting trusses can be more efficiently and critically manufactured than trusses constructed completely on-site and can be more efficiently transported in their component states than can trusses which are completely assembled prior to delivery to the construction site. The fact that the truss components are identical in some embodiments aids in the mass production of the truss components.

The truss components of the present invention can be fabricated and mated using conventional structural materials and fasteners. Known structural materials such as wood, steel, aluminum, plastics, reinforced fiberglass, ceramics or combinations thereof can be employed. For reasons of economy, beauty and strength, wood is preferred, particularly Douglas Fir or Southern Yellow Pine.

Fastening means used in assembling and mating the truss components can be any of the conventional fastening means such as bolts, nails, rivets, adhesives or welding or brazing and the like. A particularly useful means of fastening the members is by the use of self-nailing fasteners such as available commercially under the trade-name "Panel Clips", available from the Panel Clip Company.

The advantages and variations of the trusses of the present invention can be more clearly seen by reference to the accompanying drawings.

While the present invention is susceptible of embodiment in many different forms, the drawings herein will detail several such embodiments exemplifying the principles of the present invention.

Figure 1:
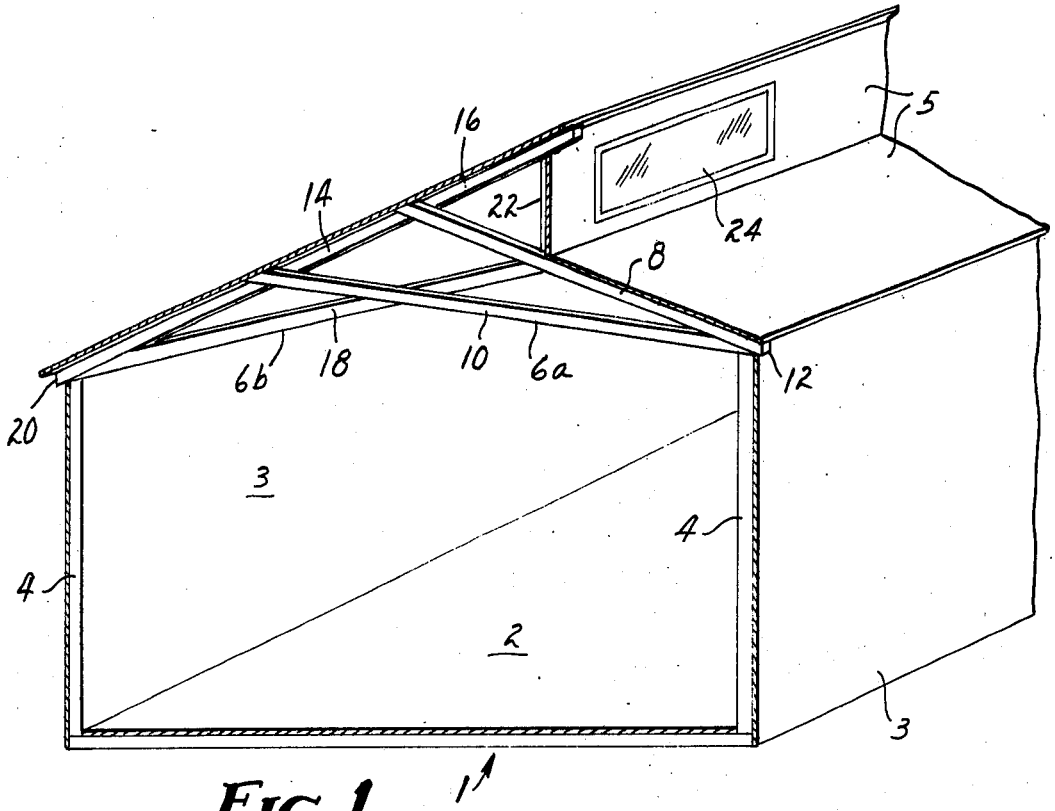
FIG. 1 is a perspective fragmented view of a building module incorporating an extended scissors truss of the present invention.

Referring now to FIG. 1 of the drawings there is shown a building module 1 comprising floor 2, walls 3, wall studs 4 and roof 5 supported by an extended truss comprising complementary truss components **6*a* and 6*b*. Truss component 6a comprises a framework of wooden structural members including longitudinally extending members forming coplanar upper chord 8 and lower chord 10 intersecting and connecting at distal end or "foot" 12. Transverse member 14 connects chords 8 and 10 maintaining said chords in fixed, angled relation and forming with chords 8 and 10 triangular truss component 6*a***.

Truss component **6*b* includes longitudinally extending members forming coplanar upper chord 16 and lower chord 18 intersecting and connecting at foot 20. Transverse member 22 connects chords 16 and 18 maintaining said chords in fixed, angled relation and forming with chords 16 and 18 triangular truss component 6*b*. Additional transverse members similar to 14 and 22** can be used to provide added strength if desired.

Complementary truss components **6*a* and 6*b* are mated in partially juxtaposed relation to form an extended scissors truss and held in fixed, mated relation by fastening means (not shown), such as by bolting, nailing, glueing or the like, where the complementary chords overlap. Juxtaposing complementary truss components 6*a* and 6*b* such that complementary lower chords 10 and 18 cross with their ends overlapping complementary upper chords 16 and 18 forms a scissors truss. Extension of upper chord 16 beyond complementary upper chord 8 provides an extended truss which can support a "sawtooth", ventilated roof with vent 24 incorporated in the vertical portion of roof 5. Optionally, the vents 24 may be replaced with windows or skylights to provide unique interior lighting effects in building module 1**.

The truss design of this invention provides a prefabricated truss having an extended portion integral with the roof-supporting chords of the trusses rather than as an "added on" portion. If temporary fastening means, such as conventional bolts, are used to assemble the trusses, they may be advantageously used in temporary structures which can be readily disassembled after use.

Prefabricated building modules employing prefabricated floor, wall and roof panels together with the prefabricated trusses of the present invention can be readily assembled on-site in conveniently sized modules, e.g., 6 or 8 feet in length, such as shown in FIG. 1, and interconnected by means shown in the art to form larger, multi-module buildings for storage and the like.

The modules can be readily disassembled if temporary fastening means are used in assembly.

Figure 2:
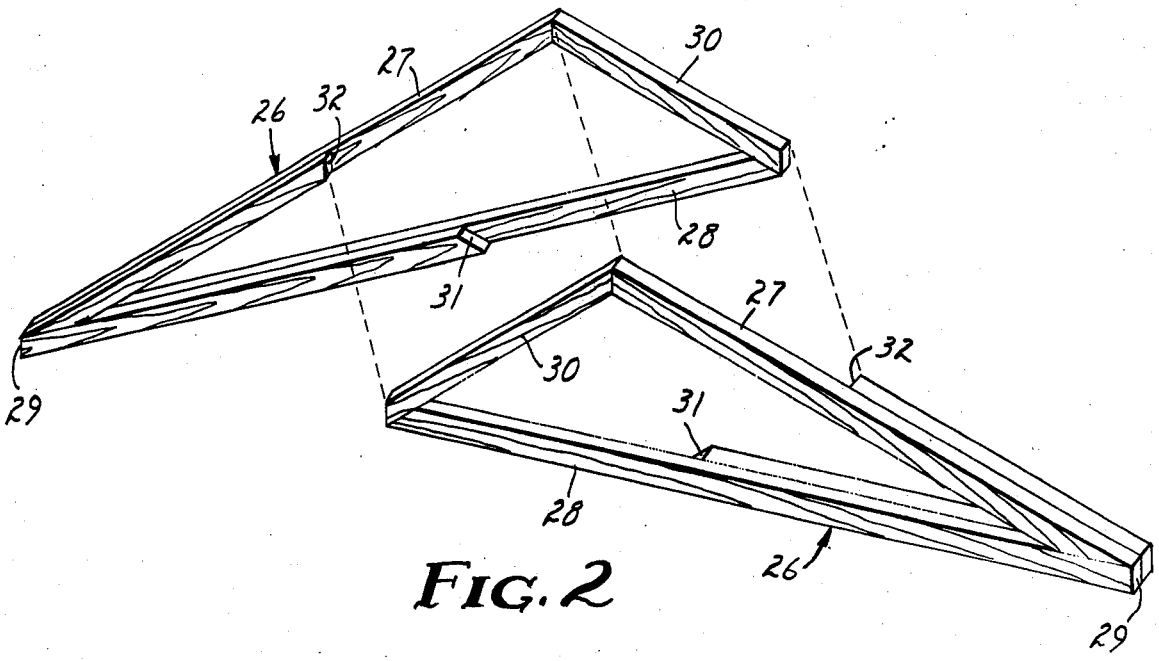
FIG. 2 is a perspective exploded view of a prefabricated, interlocking peaked truss showing the fabricated truss components in the relative position the components occupy in the assembled truss.

In FIG. 2 there is shown identical complementary truss components 26 in facing, interlocking relation. Each of the complementary truss components 26 comprises upper chord member 27 and lower chord member 28 intersecting and connecting to form foot 29, such as by beveling the end of upper chord 27 (or lower chord 28) to provide maximum surface contact between chord 27 and chord 28. Chords 27 and 28 are connected at their spaced ends remote from foot 29 by transverse member 30, which member aids in maintaining chords 27 and 28 in the proper angled relation. As shown in the FIGURE, member 30 can be beveled at one or both ends to allow maximum surface contact with chords 27 and 28.

Scissors support 31 is positioned to support complementary lower chord 28 when truss components 26 are juxtaposed. Scissors support 31 is shown in the FIGURE as an extended member doubling the width of a portion of lower chord 28 and is beveled to provide maximum surface contact between support 31 and complementary lower chord 28. Alternatively, support 31 can be a projection or node attached to lower chord 28 (as shown hereinafter) and need not be extended to act as a doubler member where such doubling strength is not required.

Scissors stop 32 is shown as an extended member doubling the width of a portion of chord 27 and is adapted to engage and support complementary lower chord 28 where lower chord 28 meets or crosses upper chord 27. As with scissors support 31, stop 32 can be abbreviated in length and can be a short projection or node extending from chord 27 where the doubling strength of the extended member is not desired.

Truss components 26 can be fabricated by assembling the above-described members with fastening means (not shown), such as by bolting, nailing, glueing, or other means which will hold the members in substantially fixed relation, such as by welding or brazing when the members are formed of metals. Further, the fabricated truss components 26 can be mated to form the trusses of the present invention by conventional fastening means, such as by bolting, nailing, glueing, welding, brazing, or any other means which is suitable. Positioning of the fastening means (not shown) used in mating the truss components is not critical, and the quantity and strength of the fastening means is less critical than in conventional trusses since the only function of the fastening means used in mating the truss components is to maintain the truss components in the proper mated, interlocking relationship, wherein the forces exerted upon the truss are borne within the truss components and not directly by the fastening means used to mate the truss components. The members used in fabricating the truss components may be rectangular, triangular, rounded, beveled, or any other shape which will permit the members to function as explained herein.

Figure 3:
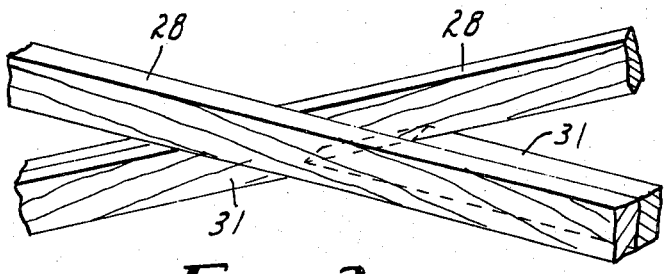
FIG. 3 is a perspective view of a scissors cradle portion of the truss shown in FIG. 2.

FIG. 3 is an enlarged detailed view showing a portion of FIG. 2, wherein intersecting complementary lower chords 28 are shown supported by scissors support 31 which in combination form the scissors cradle portion of the truss to provide means resisting relative angular movement of the truss components.

Figure 4:
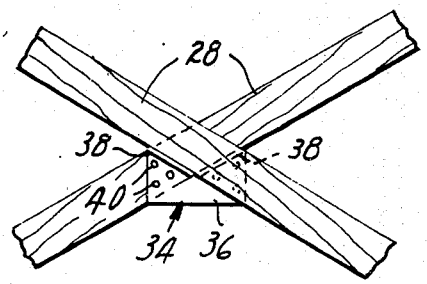
FIG. 4 is a side view of an alternate scissors cradle assembly useful in the present invention.

FIG. 4 shows an alternative embodiment of a scissors cradle wherein complementary lower chord members 28 cross and are supported by unitary scissors cradle element 34 (shown partly in phantom). Unitary scissors cradle element 34 comprises attaching plate 36 and scissors support plates 38 and cradle element 34 attached to chords 28 by bolts 40 and provides a scissors cradle which resists relative angular movement of the mated truss components and is useful in the construction of the trusses of the present invention. Cradle element 34 can be made of metal or any other rigid material.

Figure 5:
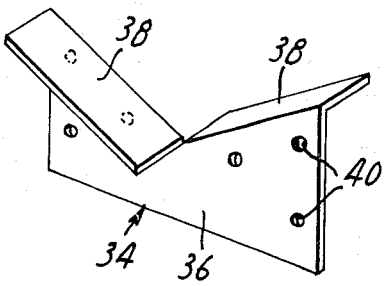
FIG. 5 is a perspective view of a scissors cradle element useful in the present invention.

FIG. 5 shows a unitary scissors cradle element 34 comprising flat, vertical attaching plate 36 and integral therewith a pair of support plates 38 depending from opposite sides of the uppermost edges of plates 36 at right angles to the plane of plate 36. The upper surfaces of support plates 38 are disposed such that each of the surfaces slope toward the center of plate 36. Openings 42 provide means for receiving fasteners such as bolts and cradle element 34 to the lower chords of the truss components of this invention as shown in FIG. 4. Openings 42 are located to facilitate attachment to the chords.

Figure 6:
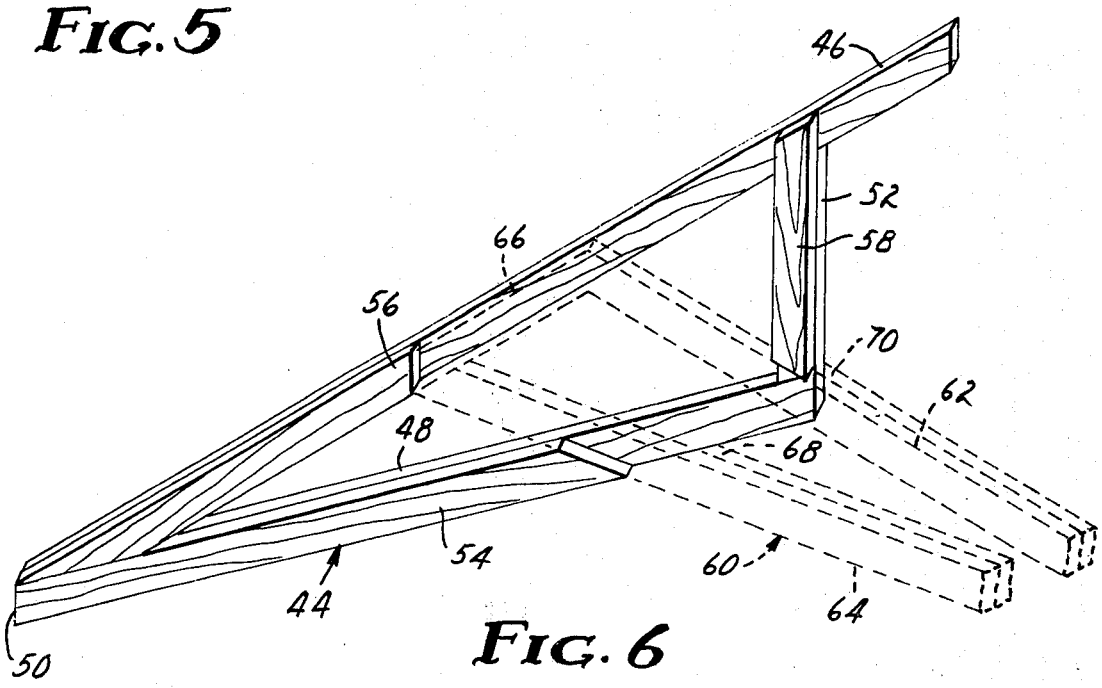
FIG. 6 is a perspective view partially in phantom showing an assembled, extended, interlocking truss according to the present invention.

FIG. 6 is a perspective fragmented view of one embodiment of an extended scissors truss according to the present invention. Extended truss component 44 comprises extended upper chord 46 and coplanar lower chord 48 meeting to form foot 50 and having chords 46 and 48 maintained in fixed, angled relation by transverse member 52. Supporting means are provided by scissors support 54 which is shown as an extended lower doubler chord having a beveled support end. Scissors stop 56 is shown extended to form an upper doubler chord and transverse support 58 is also shown extended to form a transverse doubler member. As noted previously, support means 54, 56, and 58 need not be extended where the strength of the doubler members is not required.

Complementary truss component 60 (shown in phantom) comprises upper chord 62 and lower chord 64 meeting to form a foot (not shown) similar to foot 50 with chords 62 and 64 maintained in fixed angled relation by transverse member 66. Means are provided by complementary truss component 60 to support truss component 44 such as scissors support 68 engaging and supporting lower chord 48 of truss component 44 and scissors stop 70 engaging lower chord 48 of truss component 44. Conventional fastening means (not shown) as noted previously are used to maintain the truss components in mated interlocking relation.

Figure 7:
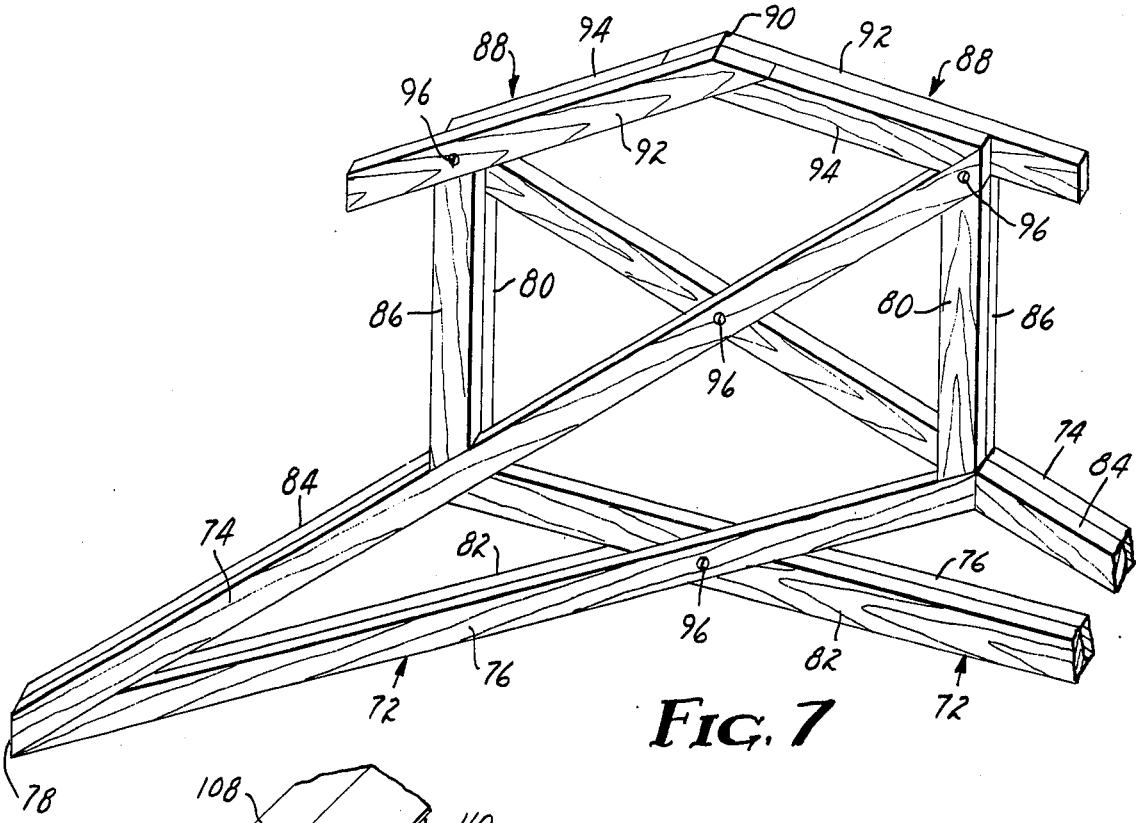
FIG. 7 is a perspective view showing a doubly-extended interlocking truss.

FIG. 7 is a perspective fragmented view of a further embodiment of an extended scissors truss according to the present invention, wherein identical complementary truss components 72 each comprise upper chord 74 and lower chord 76 which meet at foot 78 (one of the complementary feet is not shown). The upper chord 74 and lower chord 72 are maintained in fixed, angled relation by transverse member 80. Complementary supporting means are provided by scissors support 82, scissors stop 84, and transverse support 86. These support members are adapted to engage and support the complementary truss component, thereby preventing relative rotation and outward movement of the feet of the truss under load. As shown herein, support means 82, 84, and 86 are elongated beveled members which, in effect, double the width of a portion of the chords 74, 76 and transverse member 80 to which they are shown attached. As noted previously, this is an optional feature of the present invention, but is preferred where the individual members are too weak or only marginally strong enough to carry the anticipated loads. Where single thickness members are adequate, the supports may be shorter projections or nodes which serve the necessary supporting function such as the support plates 38 shown in FIG. 4.

Secondary roof supporting components or chords 88 are identical and are supported by truss components 72 and interlock to form peak 90. Chords 88 comprise extended member 92 and doubler member 94. Member 92 is adapted to rest on and be supported by transverse member 86 of truss component 72, while doubler member 94 rests on and is supported by upper chord 74 of truss component 72. The secondary chords 88 are optional and truss components 72 can be used without them where a non-peaked roof profile, such as a troughed "butterfly" roof profile is desired.

Components 72 and 88 are shown mated by bolts 96 which maintain the components in fixed interlocking relation.

Figure 8:
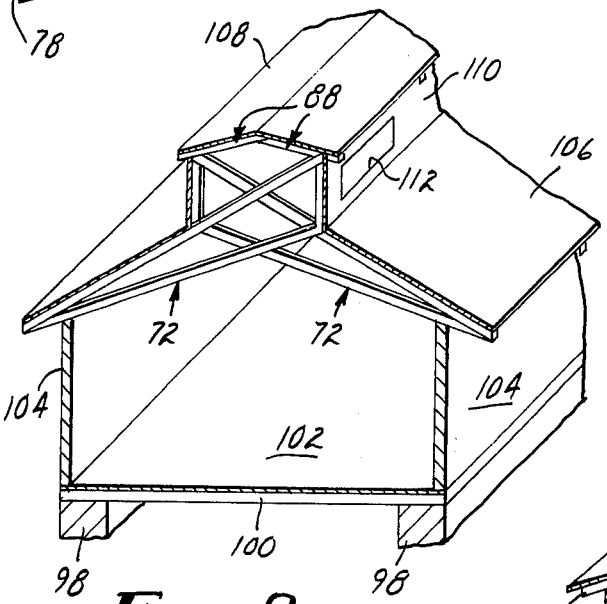
FIG. 8 is a perspective fragmented view of a building incorporating the truss of FIG. 7 to provide a ventilated roof.

FIG. 8 is a perspective view of a static structure having a ventilated roof. The building is shown supported by foundation walls 98 upon which floor joists 100 rest. Floor 102 is secured to joists 100 and walls 104 rest on floor 102. The foundation, floor, and walls can be formed by conventional construction techniques known in the art. Truss components 72 (shown in detail in FIG. 7) rest on walls 104 and support roof 106, ventilator roof 108, and ventilator walls 110. Opening 112 in ventilator walls 110 provide air circulation throughout the building and can be screened, louvered, or otherwise constructed to provide the ventilating effect. Structures having roofs of this type are particularly useful as dairy barns to provide means for thoroughly ventilating the interior of the barns and permitting the animal heat and odors to escape to the exterior.

Figure 9:
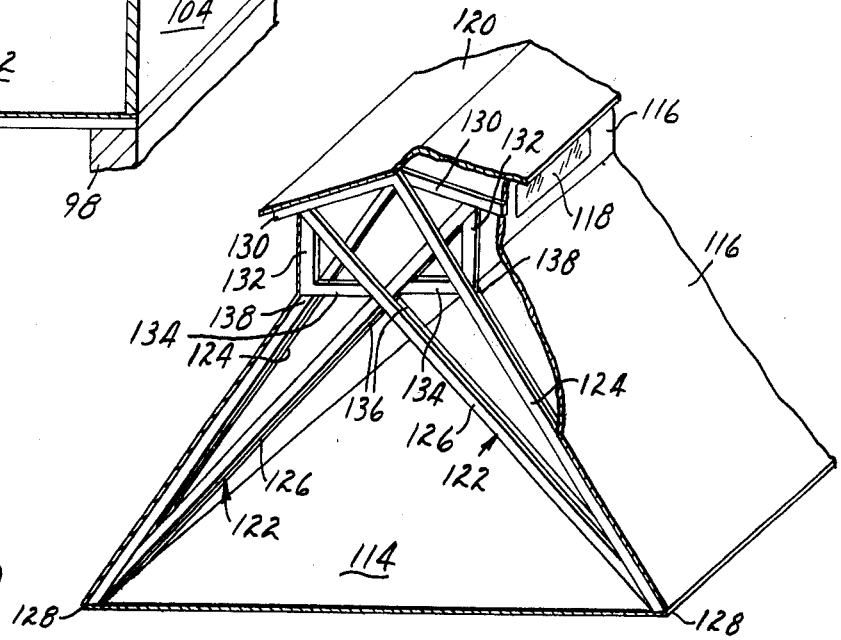
FIG. 9 is a perspective fragmented view of a modified A frame building incorporating an interlocking extended truss supporting the roof and walls of the building.

FIG. 9 is a perspective cross-sectional view of a modified A-frame building comprising supporting floor 114, such as a concrete slab, conventional wood flooring supported by a basement foundation, or the like, side walls 16 containing windows 118 and peaked roof 120. The roof and walls are supported by a modified peaked truss composed of identical complementary truss components 122. Truss components 122 each comprises a framework of rigid structural members including longitudinally extending members forming coplanar upper and lower chords 124 and 126, respectively, meeting to form foot 128. Transverse member 130 connects chords 124 and 126 in fixed angled relation and with members 126 and 128 forms a triangular truss core. Transverse member 130 also serves as a roof-supporting member for peaked roof 120. Vertical auxiliary truss member 132 and horizontal auxiliary truss member 134 are provided to support the vertical portion of wall 116. Horizontal member 134 may be used to support an optional false ceiling (not shown) or flooring means for an "attic" or upstairs living area.

As with the other trusses shown herein, support means may optionally be incorporated to provide an interlocking, self-supporting truss. As shown in FIG. 9 scissors support 136 engages and supports complementary lower chord member 122 and is shown as an extended doubler member extending to foot 128 of truss component 122. Scissors stop 138 is shown attached to upper chord 124 and engages complementary auxiliary truss member 134. Scissors stop 138 is shown as an extended doubler member, also extending to foot 128 of truss component 122.

As can be seen from the foregoing discussion, the trusses of the present invention offer substantial advantages over the prior art trusses owing to their ease of assembly or mating at the construction site. The interlocking trusses of the present invention offer the unique advantage that the fastening means employed in mating the complementary truss components need carry none of the shear forces between the mated truss components since these forces are distributed within the truss members and counteracted by the support means such as the scissors support and scissors stop means built into the truss components.

The use of ventilated, skylit and clerestory roofs is also facilitated by the unique design of the present trusses. The width and angled relation of the upper and lower chords of the trusses can provide air circulation space between the outer roof and a false ceiling which may be attached to the lower chords. Thus, vents in the eave portion of the roof supported by the truss can provide an inlet for circulating air which can be expelled from a vent near the peak of the roof, which vent can be conveniently protected by a secondary roof provided by the extended trusses of the present invention as for example in FIGS. 1, 8 and 9.

As noted previously, the truss components can be identical or different. Thus, trusses can be assembled from unlike truss components, e.g., truss components of differing chord length and/or overall length, to provide a building having an off-centered roof ridge wherein the truss peak or the crossing point between either or both of the complementary truss chords is not equidistant between the feet of the truss.

What is claimed is:

1. A scissors truss comprising a framework of rigid structural members forming a pair of distinct, mated complementary truss components, each of said components comprising distinct longitudinally extending continuous members forming corresponding upper and lower chords, said chords being in angled relation whereby said lower chord intersects and connected with said corresponding upper chord, a transverse member adjacent an end of at least one of said chords and connecting said upper and lower chords to form a triangle, said complementary truss components juxtaposed and mated to form a scissors truss and including fastening means mating said truss components and resisting relative angular movement of said truss components and wherein at least one upper chord crosses and extends beyond the complementary upper chord.

2. A static structure comprising a floor, walls, and roof, and a supporting truss for said walls and roof, the feet of said truss resting on and being supported directly by the floor of said structure wherein the improvement comprises supporting said walls and roof with at least one scissors truss according to claim 1.

3. A scissors truss according to claim 1 wherein said transverse member intersects one of said chords between the ends of said chord.

4. A building module comprising a floor, walls, roof-supporting truss and roof wherein the improvement comprises supporting said roof with at least one scissors truss according to claim 1.

5. A static structure comprising a floor, walls, roof-supporting truss and roof wherein the improvement comprises supporting said roof with at least one scissors truss according to claim 1.

6. A static structure according to claim 5 wherein said structure has a ventilated roof.

7. A scissors truss comprising a framework of rigid structural members forming a pair of distinct, mated complementary truss components, each of said components comprising distinct, longitudinally extending continuous members forming corresponding upper and lower chords, said chords being in angled relation whereby said lower chord intersects and connects with said corresponding upper chord, a transverse member adjacent an end of at least one of said chords and connecting said upper and lower chords to form a triangle, said complementary truss components juxtaposed and mated to form a scissors truss and including means substantially preventing outward movement of the distal portions of said truss components comprising a scissors support attached to each of the lower chords of the truss components and a scissors stop on the upper chord of at least one of said truss components, each of said scissors supports being a member protruding from said lower chord positioned to abut the complementary lower chord, said scissors stop being a member protruding from said upper chord positioned to abut the complementary lower chord at the point where said complementary lower chord crosses said upper chord.

8. A scissors truss according to claim 7 wherein the complementary upper chords form a peaked truss.

9. A scissors truss according to claim 7 wherein at least one lower chord crosses and extends beyond the complementary upper chord.

10. A scissors truss according to claim 7 wherein said mated truss components are identical and each of said upper chords crosses and extends beyond each of said complementary upper chords when said components are mated, said scissors truss including secondary roof supporting chords supported by and attached to said extended upper chords and forming a peaked secondary roof support.

11. A scissors truss according to claim 7 wherein at least one upper chord crosses and extends beyond the complementary upper chord.

12. A scissors truss according to claim 11 including a transverse support attached to said transverse member of at least one of said truss components, said transverse support being a member protruding from said transverse member positioned to abut the upper chord of the complementary truss component.

13. A scissors truss according to claim 11 wherein said transverse member intersects one of said chords between the ends of said chord.

14. A scissors truss comprising a framework of rigid structural members forming a pair of distinct, mated complementary truss components, each of said components comprising distinct, longitudinally extending continuous members forming corresponding upper and lower chords, said chords being in angled relation whereby said lower chord intersects and connects with said corresponding upper chord, a transverse member adjacent an end of at least one of said chords and connecting said upper and lower chords to form a triangle, said complementary truss components juxtaposed and mated to form a scissors truss and including fastening means mating said truss components and resisting relative angular movement of said truss components and wherein at least one lower chord crosses and extends beyond the complementary upper chord.

15. A scissors cradle element adapted to support the lower chords of a scissors truss, said element comprising a flat vertical attaching plate and integral therewith a pair of support plates each depending from opposite sides of the uppermost edges of said attaching plate at right angles to the plane of said attaching plate, the upper surfaces of said support plates disposed such that each of said surfaces slope toward the center of said attaching plate.

* * * * *